United States Patent [19]

Vratny

[11] 4,238,682

[45] Dec. 9, 1980

[54] HIGH-POWER X-RAY SOURCE

[75] Inventor: Frederick Vratny, Berkeley Heights, N.J.

[73] Assignee: Bell Telephone Laboratories, Incorporated, Murray Hill, N.J.

[21] Appl. No.: 35,473

[22] Filed: May 3, 1979

[51] Int. Cl.[3] ..... H01J 35/00

[52] U.S. Cl. ..... 250/420; 250/402

[58] Field of Search ..... 250/401, 402, 419, 420; 313/11

[56] References Cited

U.S. PATENT DOCUMENTS

| | | | |
|---|---|---|---|
| 3,171,029 | 2/1965 | Boucher | 250/419 |
| 3,517,195 | 6/1970 | Leavitt | 250/419 |

*Primary Examiner*—Craig E. Church

*Attorney, Agent, or Firm*—Lucian C. Canepa

[57] ABSTRACT

Even ultra-thin films deposited on the surface of a high-power X-ray target anode (14) during water cooling thereof form thermal barriers that significantly limit the lifetime of the anode. The deposition of such films on the anode is minimized by utilizing several techniques. These include the use of low-corrosion metals such as high-chrome stainless steel in the cooling system, preferential etching of the water-carrying metallic members to provide chrome-rich surfaces, and complexing the metallic hydroxides that are produced in the cooling medium to hold them in a highly soluble state even in the immediate vicinity of the hot anode. These techniques, coupled with submicron filtering and systematic cleaning and maintenance of the cooling system, are important contributors to achieving highly reliable long-lifetime operation of a high-power X-ray source.

11 Claims, 1 Drawing Figure

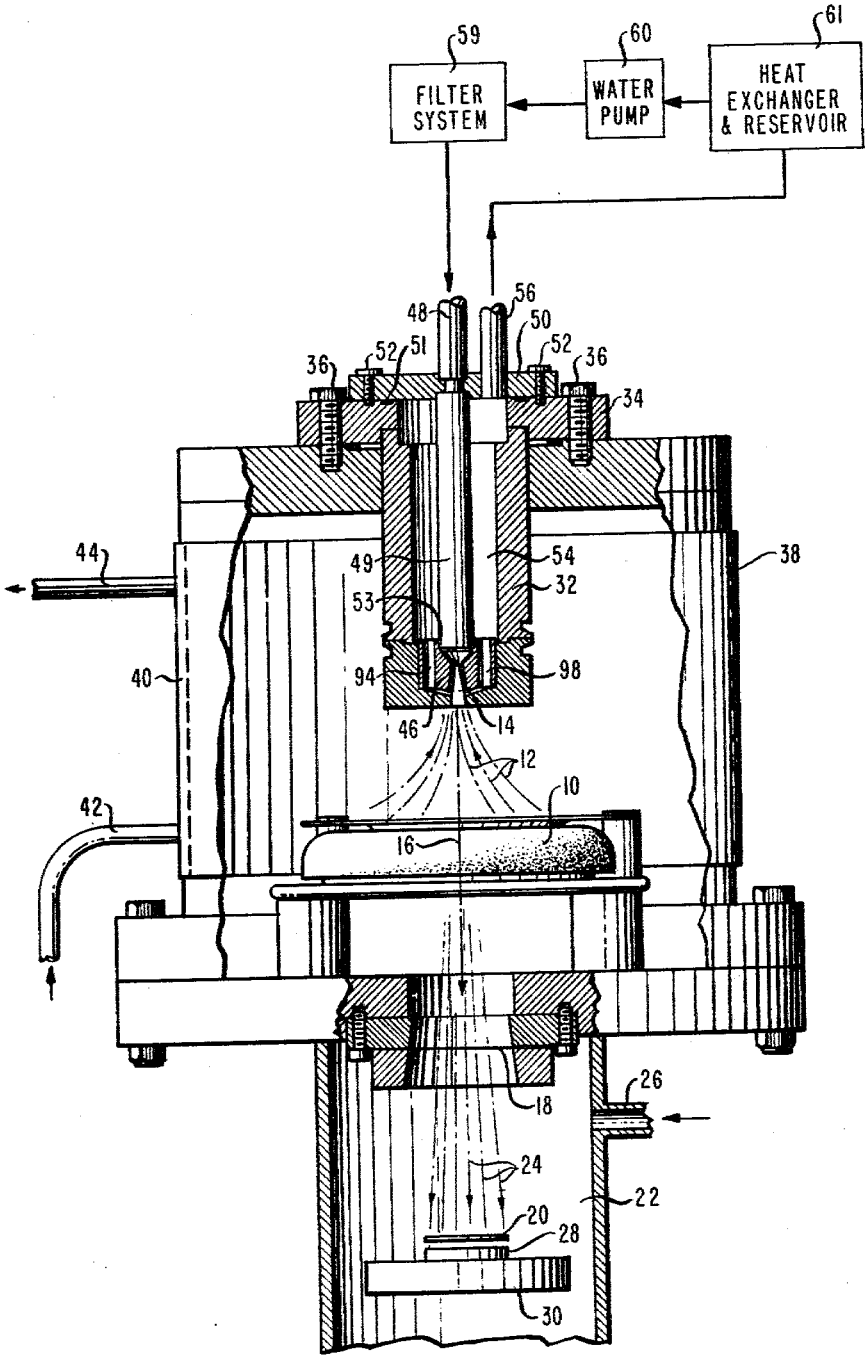
FILTER SYSTEM
WATER PUMP
HEAT EXCHANGER & RESERVOIR
59
60
61
48
56
50
52
51
52
36
36
34
44
49
54
38
53
32
40
94
98
46
14
12
10
42
16
26
18
24
22
20
28
30

HIGH-POWER X-RAY SOURCE

BACKGROUND OF THE INVENTION

This invention relates to the generation of X-rays and, more particularly, to techniques for achieving effective cooling of a target anode included in a high-power X-ray source.

X-ray generators are utilized in a variety of applications of practical importance. One significant area in which such sources are employed is the field of X-ray lithography. An advantageous X-ray lithographic system utilized to make structures such as large-scale-integrated (LSI) semiconductor devices is described in *IEEE Transactions on Electron Devices,* Vol. ED-22, No. 7, July 1975, pages 429–433. In an attempt to increase the throughput of such an X-ray lithographic system, considerable effort has been directed at trying to develop more sensitive resist materials for utilization therein and, moreover, at trying to increase the power output of the X-ray generator included in such a system.

X-ray sources including water-cooled anodes are available for use in lithographic systems. However, maintenance and reliability problems have made sources of the type heretofore available unattractive for many practical lithographic applications. Accordingly, efforts by workers in the lithographic field have been directed at trying to devise a high-power X-ray source characterized by high stability, long lifetime and low maintenance. It was recognized that such a source, if available, could be, for example, the basis for a rugged production-type X-ray lithographic system exhibiting advantageous throughput properties.

SUMMARY OF THE INVENTION

Hence, an object of the present invention is a high-power X-ray source especially adapted for use in an X-ray lithographic system. More specifically, an object of this invention is to cool the anode of a high-power X-ray source in such a way as to ensure reliable operation thereof over a relatively long period of time.

Briefly, these and other objects of the present invention are realized in a specific illustrative X-ray source that comprises a target anode. The anode is cooled by establishing a flow of water along one surface thereof. In one particular embodiment, the cooling system includes low-corrosion high-temperature-tolerant members made of high-chrome stainless steel. In a preferential etching step, the water-carrying surfaces of the stainless steel members are initially treated to remove substantial quantities of the iron and nickel constituents thereof while largely leaving intact the chromium constituent in the surface regions. As a result, extremely low-corrosion members for carrying the cooling water are thereby provided. Moreover, to deal effectively even with the relatively low level of corrosion that still is produced on the metallic surfaces and dissolved in the water, several constituents are added to the water to minimize the deposition of thin films on the anode. These techniques, coupled with submicron particle filtering and systematic cleaning and maintenance procedures, are the basis for a unique cooling system design that enables a high-power X-ray source to operate reliably for an extended period of time.

BRIEF DESCRIPTION OF THE DRAWING

A complete understanding of the present invention and of the above and other features thereof may be gained from a consideration of the following detailed description presented hereinbelow in connection with the accompanying single FIGURE drawing which shows a specific illustrative X-ray lithographic system of the type to which the principles of the present invention are particularly applicable.

DETAILED DESCRIPTION

For purposes of a specific illustrative example, emphasis herein will be directed to a particular cooling system for an X-ray source included in an X-ray lithographic system. But it is to be understood that applicant's inventive techniques are also applicable to cooling X-ray sources employed in a variety of other applications of practical importance including, for example, diffraction studies, radiography and tomography, Moreover, it will be apparent that applicant's techniques are also useful for cooling other types of systems such as, for example, plasma etching and/or deposition systems.

In a generalized schematic way, the drawing shows the major components of an X-ray lithographic system. An electron gun 10 accelerates a beam of electrons, designated by dot-dash lines 12, towards a portion of the inside surface of a conical anode 14. In response to bombardment by electrons, the anode 14 emits X-rays which propagate downwards in the FIGURE, centered about longitudinal axis 16, through a beryllium window 18 to irradiate the upper surface of a conventional X-ray mask structure 20 mounted in a cylindrical exposure chamber 22. By way of a specific example, the chamber 22 is shown open at the bottom end thereof and, for example, contains therein a helium atmosphere at a pressure slightly in excess of atmospheric pressure. Helium gas is introduced into the chamber 22 via an inlet tube 26.

X-rays directed at the mask structure 20 are designated by reference numeral 24. The mask is shown positioned in spaced-apart relationship with respect to a substrate 28 whose top surface is coated with a layer of a standard X-ray-sensitive resist material. In turn, the resist-coated substrate is mounted on a conventional work table 30.

The anode 14 shown in the drawing is mounted in a circular opening on the bottom surface of a cylinder 32 which includes an upper cylindrical flange portion 34. In turn, the flange portion 34 is secured by screws 36 to the upper surface of a cylindrical vacuum chamber 38. Illustratively, the pressure within the chamber 38 is maintained in the range $10^{-9}$ to $10^{-8}$ Torr. Advantageously, the chamber 38 is constructed to include two spaced-apart walls that form between them a cooling jacket 40. Cooling of the chamber 38 is accomplished, for example, simply by circulating tap water through the jacket 40 via respective inlet and outlet pipes 42 and 44.

The structure and operation of the electron gun 10 represented in the drawing herein are described in detail in a commonly assigned concurrently filed application designated J. R. Maldonado Ser. No. 035,472. In addition, as described in the Maldonado application, cooling of the anode 14 is carried out by directing a fluid such as water over the top surface of the anode in a precisely controlled manner. As described therein, this is done by positioning a so-called diverter 46 to encompass a portion of the anode 14. Fluid is delivered to the diverter by means of an inlet pipe 48 that is mounted in a disc 50 which is secured to the flange portion 34 by screws 52. Advantageously, a seal is formed between the flange portion 34 and the disc 50 by interposing therebetween an O-ring 51.

Cooling fluid is directed downward over the top surface of the anode 14 via a tube 49 that constitutes an extension of the inlet pipe 48 within the chamber 54. The bottom end of the tube 49 is designed to fit into a cylindrically shaped recess portion formed in the top of the diverter 46. Advantageously, an O-ring 53 is utilized to establish a seal between the tube 49 and the diverter 46. Fluid directed through the diverter 46 then flows via an annular gap formed between the diverter and the bottom inside surface of the cylinder 32 upwards through multiple passageways formed in the diverter 46. The fluid then flows upwards through the main interior chamber 54 of the cylinder 32 and through an outlet pipe 56 mounted in the disc 50.

Further details concerning the diverter 46 and specific illustrative operating characteristics of the overall system represented in the drawing herein are contained in the aforecited Maldonado application. As described therein, a substantially uniform and turbulent flow of water characterized by nucleate boiling is established in the immediate vicinity of the surface of the target anode to be cooled.

In accordance with the principles of the present invention, various techniques are embodied in a cooling system (for example, one of the type described in the Maldonado application) to enhance the operation thereof and, in particular, to provide a reliable high-power source characterized by high stability, long lifetime and low maintenance.

Advantageously, a cooling system made in accordance with this invention includes metallic parts made of a machineable high-chrome stainless steel such as those commonly designated type 304 or 316. Thus, for example, each of the fluid-wetted parts 32, 34, 46, 48, 49, 50 and 56 shown in the drawing is advantageously made of such a material. In addition, in a preferred embodiment of applicant's invention, the aforementioned O-rings 51 and 53 are made of Teflon synthetic resin polymer. (Teflon is a trademark of E. I. duPont de Nemours and Co.) To minimize contamination in the system, all other wetted surfaces therein (such as tubing, tubing sleeves and plugs) are advantageously made either of Teflon resin or of urethane.

As indicated in the drawing, the inlet and outlet pipes 48 and 56 are connected to an assembly that comprises a filter system 59, a water pump 60 and a heat exchanger and reservoir unit 61. Illustratively, the connections therebetween are made via urethane tubing, which is schematically represented in the drawing simply by solid lines. The pump 60 is a conventional unit that includes graphite lines and vanes, and the system 59 constitutes a commercially available submicron-particle filter such as a Millipore CWDI 01203 unit made by Millipore Corporation, Bedford, Massachusetts. Such a filter provides output water at a flow rate of up to four gallons per minute with fewer than ten 0.2-micron-size particles per liter after a fifty gallon flush at two gallons per minute. Further, in one particular embodiment, the heat exchanger and reservoir unit 61 includes, for example, a tank having a capacity of about 12 liters and a heat exchanger comprising coiled high-chrome stainless steel tubing cooled, for example, by tap water at about 22 degrees C.

Applicant recognized that even deionized water supplied from an adequate central purification system can as a practical matter become sufficiently contaminated by various particulate, ionic and bacterial constituents so as to not be a suitable cooling medium for a high-power X-ray source of the particular type described herein. Thus, for example, such a medium can in practice contain metallic and plastic chips, oil, machining dust, loose surface corrosion and corrosion-generated contaminants. Unless removed from the cooling system, these contaminants can cause wear in and consequent failure of the pump 60. Additionally, unless removed, these contaminants can physically obstruct the flow of the cooling medium in the diverter-target anode regions and thereby seriously interfere with the designed cooling action in the system. Moreover, applicant recognized that even low levels of certain contaminants in the cooling medium can cause thin but highly effective thermal-barrier films to form on the surface of the target anode. In practice, such films were determined by applicant to be a main cause of premature target anode failure (burn-out) in high-power X-ray lithographic systems as heretofore constructed.

In accordance with applicant's invention, various specific procedures are utilized to ensure that the aforestated problems arising from the presence of contaminants in the cooling system are minimized. First, the above-described submicron-particle filter system 59 is effective to remove potentially troublesome particulates from the system. In addition, several cleaning and maintenance procedures as specified below are effective to minimize the presence of contaminants in the system. Moreover, several unique techniques, also described below, are employed to ensure that the build-up of thermal-barrier films on the target anode is reduced to such an extent that relatively long-lifetime operation of the dipicted system is feasible in actual practice.

All fluid-carrying components of the herein-described cooling system are first cleaned by soaking and scrubbing in specified solutions. To remove surface dirt and grease and to semi-passivate all stainless steel surfaces, all components are first soaked in solution No. 1 until repeated rubbing of the metallic surfaces with a cotton-tipped applicator indicates no gray stain. Solution No. 1 comprises 20 grams per liter of Alconox which is a standard cleaning constituent made by Alconox Inc., N.Y., N.Y., and 0.5 cubic centimeters per liter of octyl phenoxy poly ethyoxy ethanol, with the balance of each liter of solution consisting of deionized water. All components are then rinsed for about 20 minutes in deionized water.

Next, all fluid-carrying components of the cooling system are soaked and agitated in solution No. 2 for about ten minutes or until the metallic surfaces appear a bright silver-gray in color. Solution No. 2 comprises 30 grams per liter of $NH_4Cl$ and 100 cubic centimeters per liter of HCl, with the balance of each liter of solution consisting of acetic acid. If the metallic surfaces remain dark after this treatment, the components are dipped into solution No. 3 for about one minute and then returned to solution No. 2 for about five minutes. Solution No. 3 comprises 800 cubic centimeters per liter of HF and 10 grams per liter of $NH_4Cl$, with the balance of each liter of solution consisting of deionized water. Successive exposures to solutions 2 and 3 are made if required, with scrubbing, sloshing or other agitation introduced if necessary to achieve the desired bright silver-gray color. The components are then rinsed in deionized water for about 20 minutes.

Solutions 2 and 3 comprise preferential acid etches that remove substantial portions of the iron and nickel constituents in the stainless steel surfaces but remove relatively small portions of the chromium constituents therein. As a result, the treated surfaces are characterized after treatment by a higher concentration of low-corrosion chrome than is exhibited by the original metallic parts.

Subsequently, free ions are effectively removed from the surfaces of the treated metallic components by soaking and scrubbing these components in solution No. 4 for 5-to-10 minutes. This cleaning step involves forming highly soluble compounds or complexes that include the metallic ions. The parts are then rinsed in deionized water for a minimum of five minutes. Solution No. 4 comprises 30 grams per liter of disodium ethylene dinitrilo tetra acetic acid (hereinafter referred to as EDTA), 40 grams per liter of ammonium citrate and 10 grams per liter of sodium bicarbonate, with the balance of each liter of solution consisting of deionized water.

The components are then air dried and assembled in the cooling system depicted in the drawing herein, but without any filter cartridges installed in the system 59. At that point, the cooling system is filled with solution No. 5, which is circulated in the system for about 15 minutes. This serves to complex any residual iron and nickel left on the metallic components or added to the system during assembly thereof. Solution No. 5 comprises 1.5 grams per liter of EDTA, with the balance of each liter comprising deionized water, each liter being adjusted to a pH of $6.5\pm0.5$ by adding $K_2CO_3$ thereto.

The cooling system is then drained of solution No. 5 and flushed with deionized water for about 20 minutes. The filter cartridges are then installed in the system 59. Next, the cooling system is flushed with deionized water for about 30 minutes to remove contaminants introduced into the system by the newly installed cartridges.

At that point, it is advantageous to flush the cooling system with solution No. 6, which is designed to prevent bacterial growth on the components of the system. Solution No. 6 comprises one liter of a 20 percent formaldehyde-80 percent deionized water mixture added to the cooling system, with the system being filled to capacity by adding additional deionized water thereto.

After inspecting and adjusting all fittings, seals, hoses, etc., the herein-described cooling system is then ready for actual operation. In operation, a medium designated solution No. 7 is utilized to provide effective cooling of the herein-considered target anode. Solution No. 7 comprises 0.1 gram per 500 cubic centimeters of EDTA, with the remainder of the 500 cubic centimeters constituting deionized water and sufficient $K_2CO_3$ to adjust the pH of the solution to $6.5\pm0.5$. This solution is then diluted with additional deionized water to fill the cooling system to capacity. In one specific embodiment, the overall capacity of the cooling system was about 12 liters.

The aforespecified procedures are effective to thoroughly clean the cooling system and to prepare the fluid-carrying metallic surfaces thereof to exhibit relatively low-corrosion properties. As a result, the rate of production of metallic hydroxides on these surfaces is minimized. In turn, the concentration of metallic hydroxides dissolved in the cooling fluid is thereby reduced. Consequently, the rate of deposition of hydroxides as oxide films on the surface of the target anode, even at elevated temperatures (about 200 degrees C.), is substantially reduced relative to cooling systems as heretofore constructed.

Moreover, in accordance with another feature of the principles of the present invention, the metallic hydroxides that are dissolved in the cooling medium are complexed to form compounds that are highly soluble in the medium even at elevated temperatures. A complexing agent such as EDTA is particularly advantageous for this purpose. EDTA is characterized by the ability to form highly soluble compounds with, for example, iron, nickel and chromium. Importantly, these compounds themselves do not significantly attack the fluid-carrying metallic surfaces of the system by corrosion or direct dissolution processes.

In accordance with the principles of this invention, other complexing agents have been determined to be suitable for forming highly soluble compounds with metallic hydroxides. These compounds, which remain in solution even at the elevated temperatures exhibited at the surface of a high-power target anode, are formed by adding to the cooling medium complexing agents such as citric acid, ethanol amine, tartaric acid and glutamic acid.

Regular inspection and maintenance of the aforedescribed system are important. In accordance with one illustrative procedure, the target anode 14 is examined after every 150 hours of operation. If any discoloration or build-up is evident on the surface of the anode, cleaning thereof is undertaken. This is done, for example, by rubbing the anode surface with a cotton-tipped applicator moistened in either or both of solutions 8 and 9. Subsequently, the anode surface is thoroughly rinsed with deionized water.

Solution No. 8 is especially designed to remove iron, nickel and chrome oxide deposits from the anode surface, whereas solution No. 9 is particularly effective in removing palladium oxide deposits therefrom. (Illustratively, the anode 14 is made of pure or substantially pure palladium.) Solution No. 8 comprises 30 grams per liter of EDTA with about 30 cubic centimeters per liter of $K_2CO_3$ and sufficient deionized water added to make a one-liter mixture exhibiting a pH of approximately 10 to 11. Solution No. 9 comprises a mixture of 30 grams of $NH_4Cl$ and 100 cubic centimeters of HCl.

Furthermore, after approximately every 1000 hours of operation, the herein-described cooling system is advantageously drained and then rinsed with the aforespecified solution No. 5 for about 30 minutes. This serves to complex any residual iron and nickel in the system. In addition, solution No. 6 is then circulated in the system for about 15 minutes to protect against bacterial growth therein. Next, the anode surface is soaked for about 10 minutes in solution No. 10 which comprises a mixture of 45 grams of EDTA, 10 grams of $K_2CO_3$, 30 grams of ammonium citrate and 30 grams of urea. The urea in solution No. 10 is particularly effective in removing palladium oxide from the system.

After carrying out the aforedescribed periodic maintenance steps, the entire cooling system is rinsed with deionized water for about 20 minutes. Then, the system is filled with solution No. 7 and at that point is again ready for regular operation.

A cooling system made and operated in accordance with the teachings herein and with those in the aforecited Maldonado application has made it possible in practice to provide reliable high-power long-term operation of a target anode in a rugged production-type X-ray lithographic system.

Finally, it is to be understood that the above-described arrangements are only illustrative of the principles of the present invention. In accordance with these principles, numerous modifications and alternatives may be devised by those skilled in the art without departing from the spirit and scope of the invention.

I claim:

1. In combination in a high-power system that includes a member (14) susceptible to thermal damage, means including low-corrosion metallic elements (32, 34, 46, 48, 49, 50, 56) for directing a flow of a cooling medium over a surface of said member.

said system being CHARACTERIZED IN THAT said cooling medium includes therein a complexing agent for forming highly soluble compounds with metallic constitutents derived from said elements and dissolved in said medium thereby, even at elevated operating temperatures found at the surface of said member, substantially reducing the deposition on said surface of thin-film thermal barriers otherwise formed thereon by said metallic constituents, and wherein said member to be cooled comprises a stationary conical target anode included in a high-power X-ray lithographic system adapted to fabricate large-scale-integrated circuits.

2. A system as in claim 1 wherein said metallic elements are made of a series-300 high-chrome stainless steel, and said complexing agent comprises disodium ethylene dinitrilo tetra acetic acid.

3. A system as in claim 2 wherein said directing means comprises a water pump (60), and a heat exchanger and reservoir unit (61), and wherein said directing means is CHARACTERIZED BY also comprising a submicron particle filter (59).

4. A method of cooling a stationary conical target anode member included in a high-power X-ray lithographic system adapted to fabricate large-scale-integrated circuits, the number being susceptible to thermal damage, said method comprising the step of directing a flow of a cooling medium over a surface of said member via a cooling system that includes low-corrosion metallic elements, said medium including therein a complexing agent that forms highly soluble compounds with metallic constituents derived from said elements and dissolved in said medium thereby, even at elevated operating temperatures found at the surface of said member, substantially reducing the deposition on said surface of thin-film thermal barriers otherwise formed thereon by said metallic constituents.

5. A method as in claim 4 wherein said metallic elements are made of a series-300 high-chrome stainless steel, and wherein the surfaces of said elements to be wetted by said cooling medium are initially prepared in a preferential etching step that removes substantial portions of the iron and nickel constituents from said surfaces while removing relatively small portions of the chromium constituents therefrom, thereby to convert said surfaces to low-corrosion surfaces exhibiting higher chromium content than is characteristic of the unprepared surfaces.

6. A method as in claim 5 wherein said complexing agent comprises disodium ethylene dinitrilo tetra acetic acid.

7. A method as in claim 6 wherein said cooling medium comprises said specified complexing agent, deionized water and sufficient $K_2CO_3$ added thereto to establish a pH of $6.5 \pm 0.5$.

8. A method as in claim 7 wherein the etchant utilized in said preferential etching step comprises a first mixture of $NH_4Cl$, HCl and acetic acid.

9. A method as in claim 8 wherein said etchant comprises a second mixture of HF, $NH_4Cl$ and deionized water, and wherein said surfaces to be prepared are alternatively treated with said first and second mixtures.

10. In a system for water cooling a target anode in a high-power X-ray source to minimize the deposition of heat-insulating films on a surface of said anode, said system comprising high-chrome stainless steel members for circulating water to flow over said surface, a method which comprises the steps of preferentially etching the water-contacting surfaces of said members to provide chrome-rich surfaces, and adding constituents to the water to be circulated for complexing the metallic hydroxides that are produced in the cooling medium to hold them in a highly soluble state even in the immediate vicinity of said surface of the target anode.

11. A method of cooling a high-power target anode included in an X-ray lithographic system by flowing a medium over a surface of said anode via a recirculating cooling system that includes metallic components, said method comprising the steps of initially, and periodically thereafter during prescribed maintenance periods, flushing said system with an anti-bacterial solution to minimize bacterial growth therein, adding to said medium a complexing agent that forms highly soluble compounds with metallic constituents dissolved in said medium from said components to minimize the deposition of thermal-barrier films on the surface of said anode, and recirculating said cooling medium via a submicron particle filter to remove particulates therefrom.

* * * * *